US009658584B2

(12) United States Patent
Nishimura

(10) Patent No.: US 9,658,584 B2
(45) Date of Patent: May 23, 2017

(54) FIXING APPARATUS

(71) Applicant: CANON KABUSHIKI KAISHA, Tokyo (JP)

(72) Inventor: Shizuma Nishimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/182,357

(22) Filed: Jun. 14, 2016

(65) Prior Publication Data

US 2016/0370743 A1 Dec. 22, 2016

(30) Foreign Application Priority Data

Jun. 18, 2015 (JP) ..... 2015-123159

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS 6,336,027 B1 * 1/2002 Sakai ..... H05B 6/145 219/216
2004/0005176 A1 * 1/2004 Yokozeki ..... G03G 15/2042 399/328
2004/0141038 A1 * 7/2004 Takagi ..... G03G 15/2064 347/102
2004/0238531 A1 * 12/2004 Kikuchi ..... H05B 6/145 219/674
2015/0168881 A1 * 6/2015 Obata ..... G03G 15/206 399/329
2015/0168893 A1 * 6/2015 Yonekubo ..... G03G 15/2053 399/329
2015/0168895 A1 * 6/2015 Nishizawa ..... G03G 15/2053 399/330
2015/0168896 A1 * 6/2015 Yonekubo ..... G03G 15/2053 399/329
2016/0313683 A1 * 10/2016 Nishizawa ..... G03G 15/2042

FOREIGN PATENT DOCUMENTS

JP 2003-36964 A 2/2003
JP 2003-317924 A 11/2003
JP 2003-323069 A 11/2003
JP 2014-026267 A 2/2014

* cited by examiner

*Primary Examiner* — G. M. Hyder
(74) *Attorney, Agent, or Firm* — Canon U.S.A. Inc., IP Division

(57) ABSTRACT

A fixing apparatus for fixing a toner image on a recording material while conveying and heating, at a nip portion, the recoding material on which the toner image has been formed, the fixing apparatus including a rotary member including a conductive layer, a helical coil provided inside the rotary member, a helical axis of the helical coil extending in a generatrix direction of the rotary member, a magnetic core provided inside the helical coil, the magnetic core having a shape that does not form a loop outside the conductive layer, and a back-up member forming a nip portion together with the rotary member. In the generatrix direction, when winding pitches of the helical coil in a middle area, in end-portion areas, and in intermediate areas that are areas between the middle area and the end-portion areas are X, Y, and Z, respectively, then Y<X<Z is satisfied.

6 Claims, 6 Drawing Sheets

FIXING APPARATUS

BACKGROUND OF THE INVENTION

Field of the Invention

The present disclosure relates to a fixing apparatus included in an electrophotographic image forming apparatus.

Description of the Related Art

Electromagnetic induction heat generating systems are known as fixing apparatuses mounted in image forming apparatuses, such as an electrophotographic copying machine and a printer. In such fixing apparatuses, a fixing apparatus that includes a rotary member including a conducive layer, a helical coil provided inside the rotary member, and a magnetic core with ends that is provided in a helical shaped portion of the coil, in which the entire circumference of the conductive layer generates heat has been disclosed in recent years (Japanese Patent Laid-Open No. 2014-026267). The fixing apparatus distributes high-frequency current to the coil to generate a magnetic flux in a generatrix direction of the rotary member, generates heat in the conductive layer with an induced current flowing in a circumferential direction of the conductive layer. Then, a toner image that is formed on a recording material is fixed to the recording material with the heat of the rotary member.

Since the entire circumference of the conductive layer generates heat, the fixing apparatus has an advantage in that the time period needed for warm up the fixing apparatus is short.

However, in the fixing apparatus of Japanese Patent Laid-Open No 2014-026267, since the magnetic flux density decreases from the middle portion to the end portions of the magnetic core in the generatrix direction of the rotary member, the fixability at the end portions tend to decrease. Furthermore, when attempting to increase the heat generation amount at the end portions, the temperature in the sheet non-passing areas may rise adversely.

SUMMARY OF THE INVENTION

The present disclosure increases the fixability of the end portions while suppressing temperature rise in the sheet non-passing areas. A first aspect of present disclosure is a fixing apparatus for fixing a toner image on a recording material while conveying and heating, at a nip portion, the recoding material on which the toner image has been formed, the fixing apparatus including a rotary member that includes a conductive layer, a helical coil provided inside the rotary member, a helical axis of the coil extending in a generatrix direction of the rotary member; a magnetic core provided inside the coil, the magnetic core having a shape that does not form a loop outside the conductive layer; and a back-up member that forms a nip portion together with the rotary member. The conductive layer generates heat with an electric current flowing in the conductive layer, the electric current being induced by an alternating magnetic field generated by an electric current flowing, in the coil, and In the generatrix direction, when a winding pitch of the coil in a middle area, winding pitches in end-portion areas, and winding pitches in intermediate areas that are areas between the middle area and the end-portion areas are X, Y, and Z, respectively, then $Y<X<Z$ is satisfied.

Further features of the present invention will become apparent from the following description of exemplary embodiments with reference to the attached drawings.

DESCRIPTION OF THE EMBODIMENTS

First Exemplary Embodiment

1. Description of Outline Of Image Forming Apparatus

Figure 1:
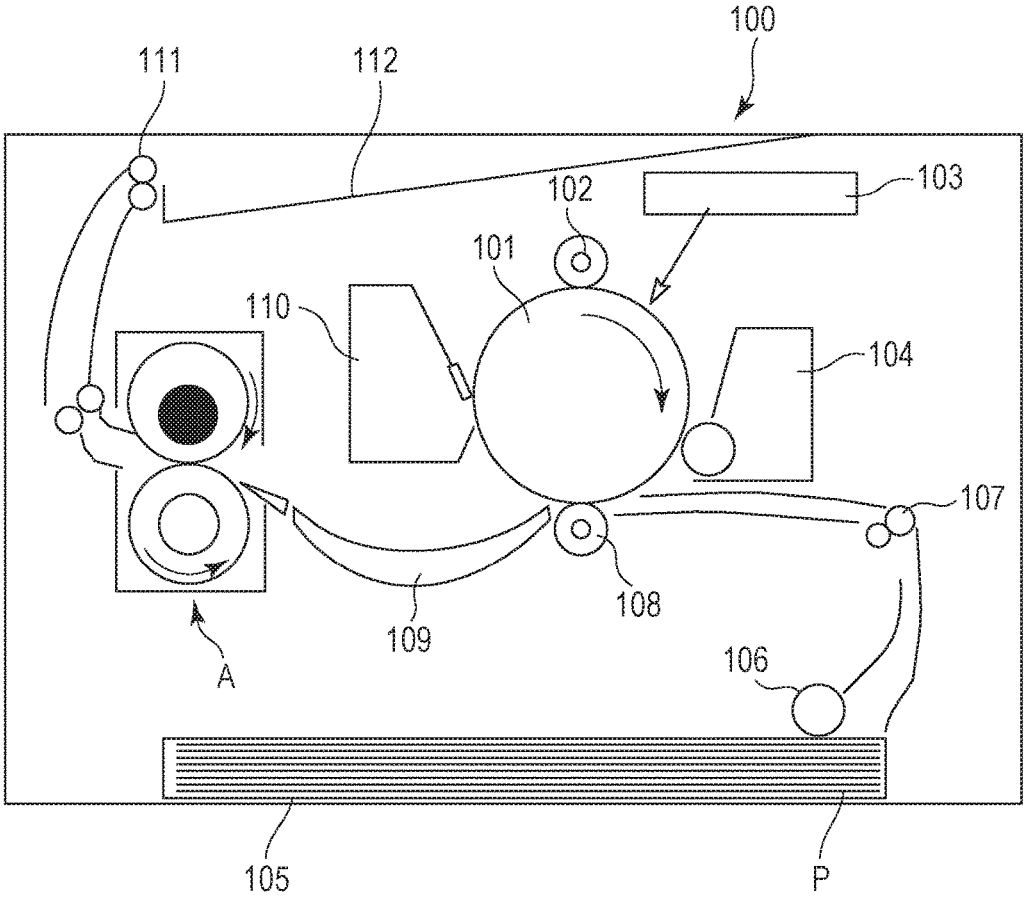
FIG. 1 is a schematic block diagram of an image forming apparatus.

Referring to FIG. 1, an image forming apparatus according to an exemplary embodiment will be described. FIG. 1 is a cross-sectional view illustrating a schematic configuration of an exemplary printer 100 that is an electrophotographic image forming apparatus.

The image forming apparatus 100 includes a photosensitive drum 101, a charging member 102, a laser scanner 103, and a developer device 104 that serve as an image forming unit for forming an unfixed toner image on a recording material P. The image forming unit further includes a cleaner 110 that cleans the photosensitive drum 101, and a transfer member 108.

The recording materials P contained in a cassette 105 inside a main body of the image forming apparatus 100 is fed sheet by sheet with a rotation of a roller 106. With a rotation of a roller 107, the recording material P is conveyed to a transfer nip portion formed by the photosensitive drum 101 and the transfer member 108. The recording material P on which a toner image has been transferred at the transfer nip portion is sent through a conveyance guide 109 to a fixing unit (hereinafter, referred to as a fixing apparatus) A. The unfixed toner image T formed on the recording material P is heat fixed on the recording material P with the fixing apparatus A. The recording material P that has exited the fixing apparatus A is discharged on a tray 112 with a rotation of the roller 111.

2. Description of Outline of Fixing Apparatus

Figure 2:
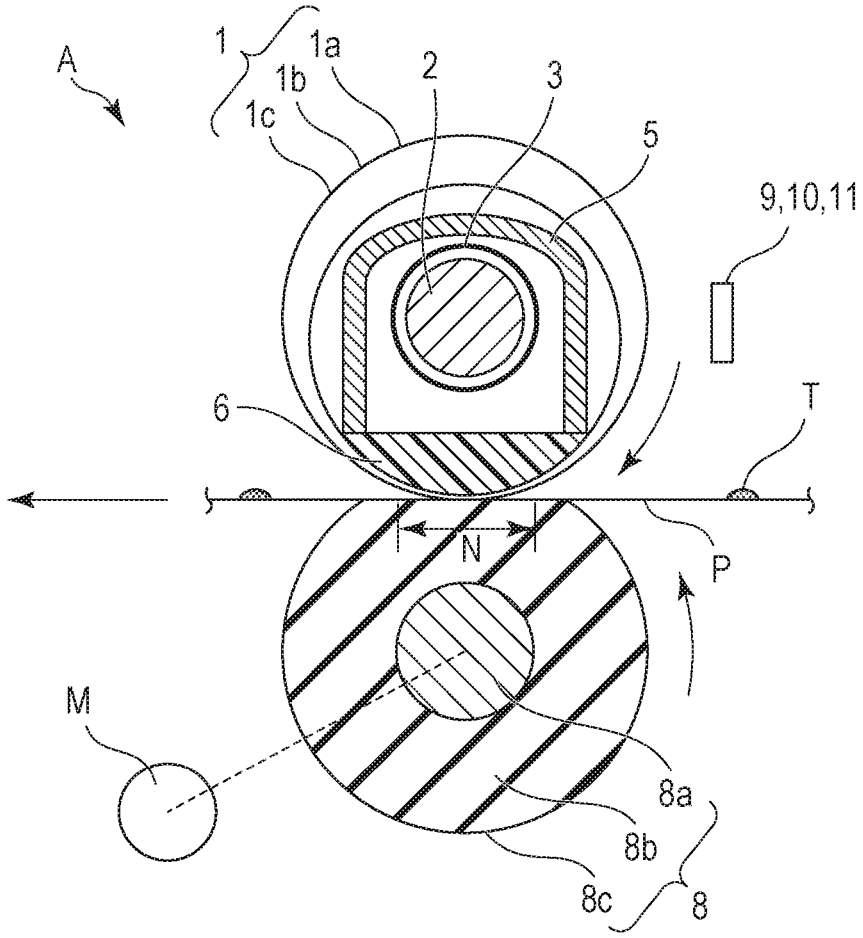
FIG. 2 is a cross section of a schematic diagram. of a fixing apparatus viewed from a lateral side.
Figure 3:
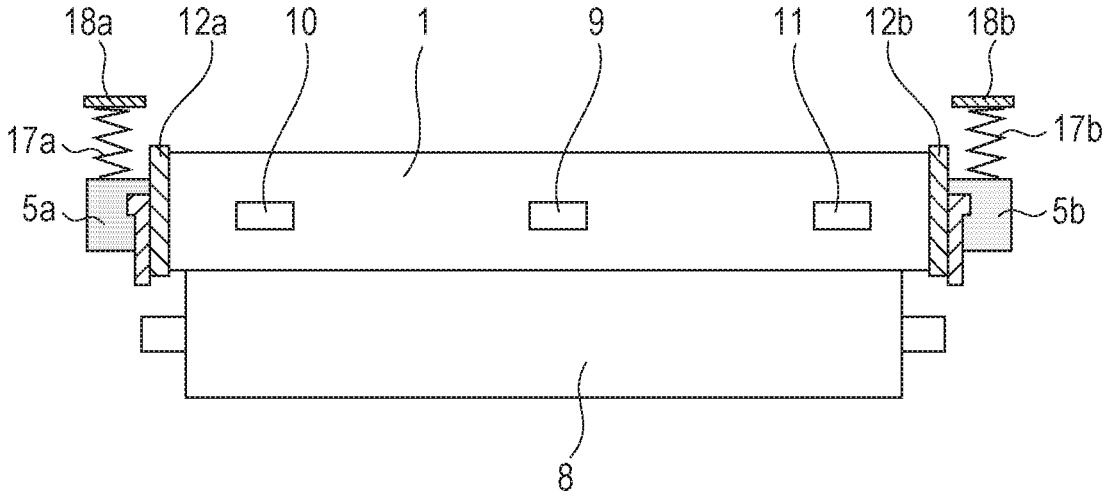
FIG. 3 is a schematic diagram of the fixing apparatus viewed from the front.

In the present exemplary embodiment, the fixing apparatus A is an electromagnetic induction heating device. FIG. 2 is a cross section of a schematic diagram of the fixing apparatus A of the present exemplary embodiment viewed from the lateral side, and FIG. 3 is a schematic diagram thereof viewed from the front.

The fixing apparatus A includes a fixing sleeve 1 including a conductive layer, a pressure roller 8 that forms a fix nip portion N by coming in contact with the fixing sleeve 1, a coil 3, a magnetic core 2, a reinforcing stay 5, and a nip portion forming member 6.

The fixing sleeve 1 serving as a rotary member includes a conductive layer 1*a*, an elastic layer 1*b* formed on an outer side of the conductive layer 1*a*, and a release layer 1*c* formed on an outer side of the elastic layer 1*b*. An outside diameter of the fixing sleeve 1 is 10 to 50 mm. A metal element tube that is 10 to 200 μm thick is used as the conductive layer 1*a*. Silicone rubber having a thickness of 0.1 to 0.5 mm and a hardness of 20 degrees (JIS-A, loading of 1 kg) is used as the elastic layer 1*b*. Furthermore, a fluorocarbon resin that is 10 to 50 μm thick is used as the release layer 1*c*. The conductive layer 1*a* of the fixing sleeve 1 of the present exemplary embodiment uses an element tube that is formed of SUS 304 and that has a diameter of 28 mm, a thickness of 40 μm, and a length of 260 mm in the longitudinal direction.

The pressure roller 8 serving as a back-up member includes a metal core 8*a*, an elastic layer 8*b* formed on an outer side of the metal core 8*a*, and a release layer 8*c* formed on an outer side of the elastic layer 8*b*. The elastic layer 8*b* is desirably formed of a material, such as silicone rubber or fluororubber, that has good heat resisting property.

Figure 4A:
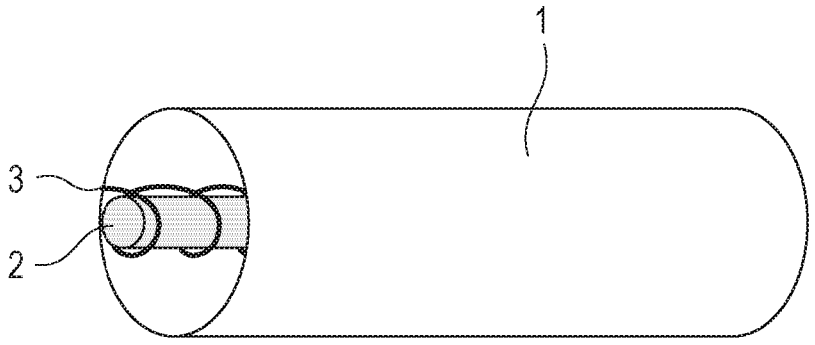
FIG. 4A is a perspective view in which a magnetic core and a coil is provided in a fixing sleeve.

FIG. 4A is a perspective view illustrating a state in which the coil 3 and the magnetic core 2 are provided inside the fixing sleeve 1. Referring to FIG. 4A, a configuration of the coil 3 and the magnetic core 2 will be described.

The coil 3 is a helical coil inside (in a hollow portion) of the fixing sleeve 1. A helical axis of the coil 3 extends in a generatrix direction of the fixing sleeve 1. The coil 3 is a copper wire coated with heat resistant polyamide-imide.

The magnetic core 2 serving as a magnetic member is fixed inside (in the hollow portion) of the fixing sleeve 1 with a fixing member (not shown). The magnetic core 2 is provided inside the helical shaped portion of the coil 3. In the present exemplary embodiment, the coil 3 is wound around the magnetic core 2. By providing the magnetic core 2, the rate of magnetic coupling between the coil 3 and the fixing sleeve 1 is increased and the conductive layer 1*a* can be induction heated with a smaller voltage. The material of the magnetic core 2 is desirably a magnetic material with a small hysteresis loss and with high relative magnetic permeability such as, for example, an oxide with high magnetic permeability, such as a sintered ferrite, a ferrite resin, an amorphous alloy, or a permalloy. The magnetic core 2 with ends is 240 to 300 mm long and the cross-section thereof is a circle with a diameter of 5 to 15 mm. In the magnetic core 2 of the present exemplary embodiment, a sintered ferrite with a diameter of 10 mm, a longitudinal dimension of 270 mm, and a relative magnetic permeability of 1800 is used. Furthermore, the coil 3 is wound around the magnetic core 2 16 times.

The magnetic core 2 with ends denoted herein is shaped so as not to form a loop outside the fixing sleeve 1.

The reinforcing stay 5 serving as a reinforcing member is a member with a U-shaped cross section formed of stainless steel, iron, or the like. The reinforcing stay 5 of the present exemplary embodiment is formed of stainless steel.

The nip portion forming member 6 is in contact with the inner surface of the fixing sleeve 1 and forms the fix nip portion N together with the pressure roller 8 with the fixing sleeve 1 in between. The nip portion forming member 6 is formed of heat-resistant resin.

A pressure applying configuration of the fixing apparatus A will be described next with reference to FIG. 3. Two end portions of the metal core 8*a* of the pressure roller 8 are rotatably supported by two chassis side plates (not shown) of the fixing apparatus A with bearings in between. Furthermore, pressure springs 17*a* and 17*b* are provided between spring receiving members 5*a* and 5*b* provided at the two end portions of the reinforcing stay 5 and spring receiving members 18*a* and 18*b* provided in the chassis side plates. With spring force of the pressure springs 17*a* and 17*b*, the reinforcing stay 5 presses the nip portion forming member 6 towards the pressure roller 8 with the fixing sleeve 1 in between. With the above, the nip portion forming member 6 forms the fix nip portion N with a predetermined width together with the pressure roller 8 with the fixing sleeve 1 in between.

A drive applying configuration of the fixing apparatus A will be described next with reference to FIG. 2. The pressure roller 8 rotates counterclockwise in FIG. 2 with driving power from a driving source M. The fixing sleeve 1 receiving frictional force at the fix nip portion N from the pressure roller 8 rotates clockwise in FIG. 2. Furthermore, flange members 12*a* and 12*b* are provided at the two end portions of the nip portion forming member 6 and are members for restricting the nip portion forming member 6 from moving in the generatrix direction of the fixing sleeve 1 during rotation of the fixing sleeve 1.

Control of supplying electric power to the fixing apparatus A will be described next. The fixing apparatus A includes non-contact temperature detection members 9, 10, and 11 provided at the center portion and the two end portions of the fixing sleeve 1. The supply of electric power to the coil 3 is controlled so that the detection temperatures of the detection members 9 are at a target temperature.

Figure 4B:
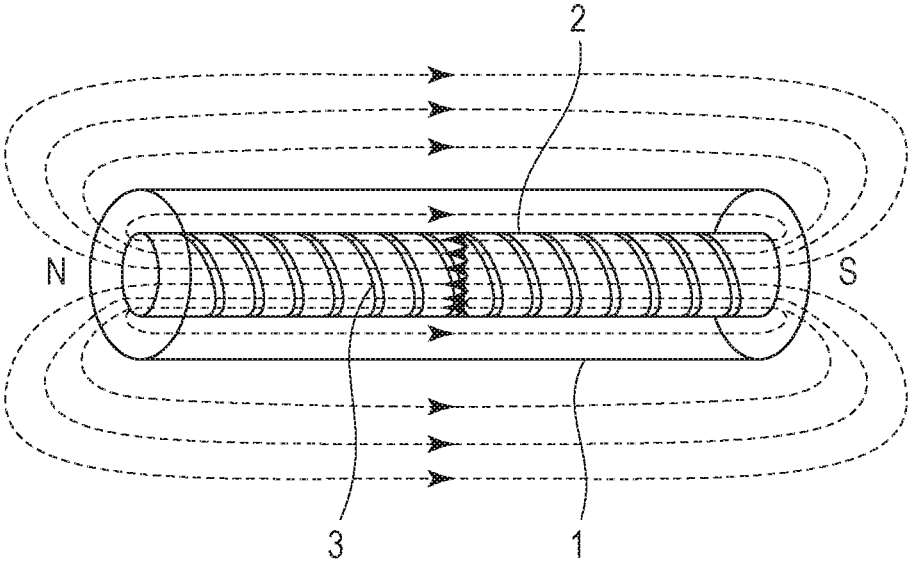
FIG. 4B is a diagram illustrating an area through which a magnetic flux passes.

With distribution of a high-frequency current to the coil 3, the fixing apparatus A generates an alternating magnetic flux (an alternating magnetic field) in the generatrix direction of the fixing sleeve 1. With the alternating magnetic flux, a current is guided so as to flow in an encircling direction is circumferential direction) of the conductive layer 1*a*. An Area through which the generated magnetic flux passes is illustrated in FIG. 4B. The fixing apparatus A is configured so that at least 70% or more, preferably 94% or more, of the magnetic flux exiting from one end of the magnetic core 2 passes the outer side of the conductive layer 1*a* and returns to the other end of the magnetic core 2. With the above, magnetic coupling between the energizing coil and the conductive layer is facilitated and conversion efficiency of the electric power (the rate in which the electric power charged to the coil 3 is consumed in the conductive layer 1*a*) can be increased. The conductive layer 1*a* mainly generates heat with the Joule heat of the electric current flowing in the encircling direction of the conductive layer 1*a*, and the entire rotary member in the circumferential direction is heated. Furthermore, while conveying, at the fix nip portion N, the recording material on which the toner image T has been formed, the toner image T is heated by the heat of the rotary member and is fixed to the recording material. Note that the temperature detection members 10 and 11 are for detecting the temperatures rise in the sheet non-passing areas when fixing a small-sized recording material. In other words, in the present exemplary embodiment, the flowing electric current guided to the conductive layer 1*a* is an electric current that mainly flows in the circumferential direction of the conductive layer 1*a*.

3. Relationship Between Coil Winding Pitch and Distribution of Heat Generation

The relationship between the winding pitch of the induction coil of the present exemplary embodiment and the distribution of heat generation will be described next. In the fixing apparatus A, since the alternating magnetic flux passes through the magnetic core 2 in the generatrix direction of the fixing sleeve 1, the fixing sleeve 1 generates heat in the entire area of the fixing sleeve 1 in the generatrix direction. None that the length of the fixing sleeve 1 is 260 mm and is longer than 216 mm that is the maximum width of the recording material (letter size) that can be used in the apparatus of the present exemplary embodiment. Accordingly, even when continuously printing a letter-size or an A4-size recording material, the temperature in the sheet non-passing area may rise. Accordingly, in the present exemplary embodiment, the winding pitch of the coil 3 is modified such that the distribution of heat generation of the fixing sleeve 1 in the generatrix direction of the fixing sleeve 1 becomes close to a rectangular-shaped distribution that matches the letter-sized recording material. With the above, temperature rise in the sheet non-passing area is suppressed and the fixability in the end portions is improved.

Figure 5A:
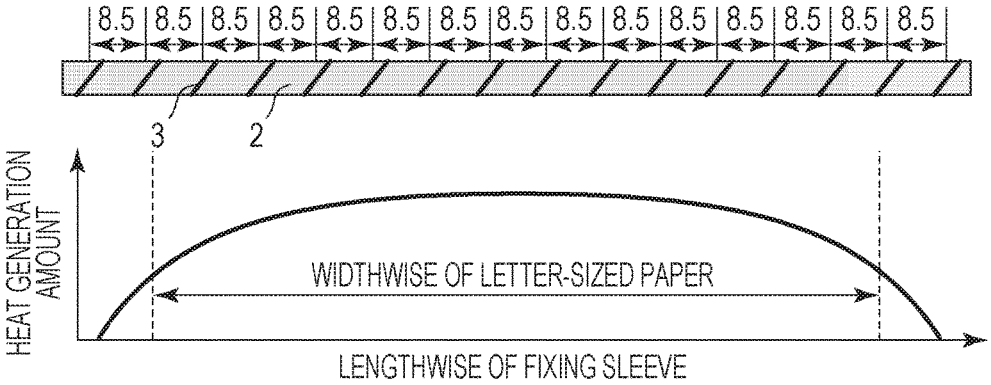
FIGS. 5A to 5C are diagrams illustrating winding pitches and heat generation distributions of induction coils.
Figure 5B:
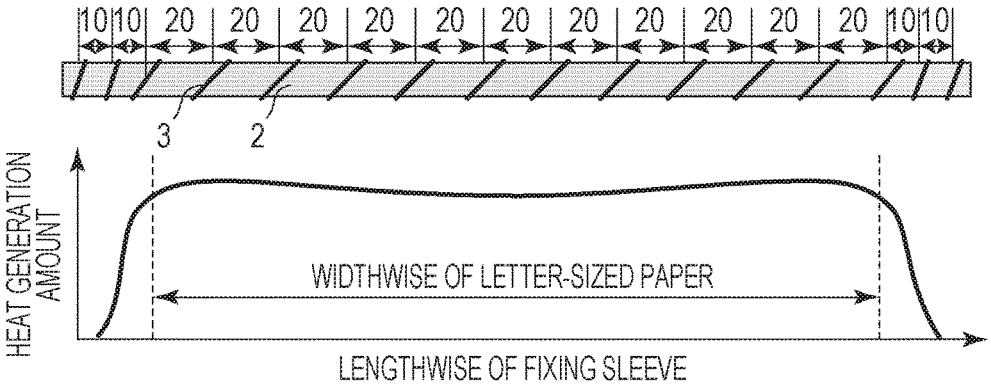
Figure 5C:
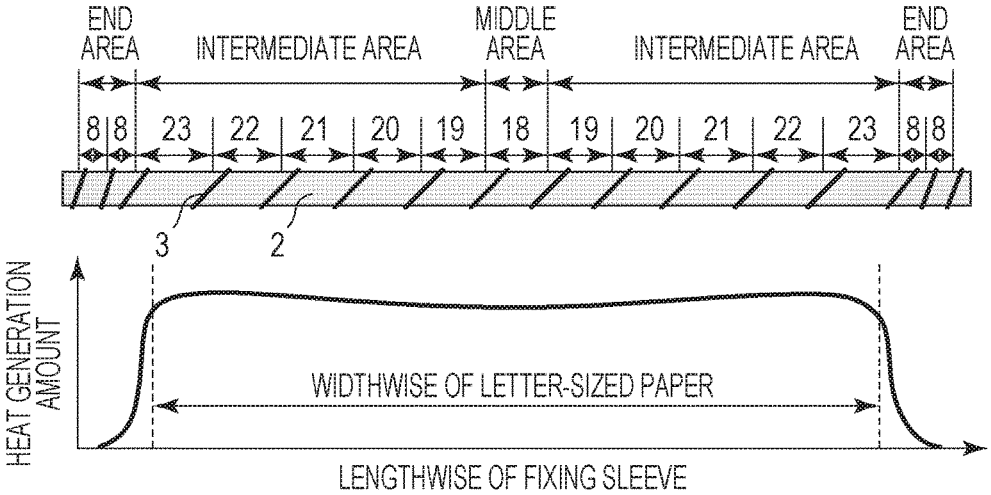

FIGS. 5A, 5B, and 5C illustrate winding pitches of the coil 3 and distributions of heat generation of the fixing sleeve 1 of a first comparative example, a second comparative example, and the present exemplary embodiment, respectively. The distributions of heat generation are calculated using an electromagnetic field simulation. In the first comparative example (FIG. 5A), the winding pitch is uniform (8.5 mm). In the second comparative example (FIG. 5B), in the generatrix direction of the fixing sleeve 1, the winding pitch in end-portion areas are smaller than that in a middle area. Specifically, the winding pitch from the middle area to the end-portion areas is 20 mm (12 windings), and the winding pitch in the end-portion areas is 10 mm (four windings). Note that the end portions of the magnetic core 2 are positioned outside the end portions of the letter-sized recording material that is the recording material having the maximum width that can be used in the fixing apparatus A.

In the first comparative example, even though the magnetic flux density is smaller in the end-portion areas than in the middle area, since the winding pitch of the coil 3 is the same in the central portion and in the end portion, the heat generation amount becomes smaller from the middle area towards the end-portion areas. In the second comparative example, since the winding pitch of the coil 3 is smaller in the end-portion areas than in the middle area, the heat generation amount of the end-portion areas is larger than that of the first comparative example. However, the heat generation amount in the letter-sized recording material non-passing area is large as well.

In the coil 3 of the present exemplary embodiment, when the winding pitch of the coil 3 in the middle area, those in the end-portion areas, and those in the intermediate areas that are areas between the middle area and the end-portion areas are X, Y, and Z, respectively, then the fixing apparatus A is configured to satisfy $Y<X<Z$. Specifically, the winding pitch of the middle area is 18 mm (one winding), the winding pitch of the end-portion area is 8 mm (four windings), and the winding pitch of the intermediate areas is 19 mm to 23 mm (11 windings). When the winding pitch of the middle area is 1.0, the winding pitch of the end-portion areas is 0.8, the winding pitch from the middle area to the end-portion areas is 1.1 to 1.3. Furthermore, the boundaries between the end-portion areas and the intermediate areas are set so as to be close to the end portions of the letter-sized recording material, which is a recording material having the maximum width that can be used in the fixing apparatus A, in the width direction. The winding pitch in the intermediate areas becomes larger from the middle area to the end-portion areas. Note that the values of X, Y, and Z are not limited to those of the present exemplary embodiment as long as when $X=1.0$, $0.1<Y<1.0$ and $1.0<Z<1.5$ are satisfied.

In the present exemplary embodiment, the end-portion areas are outside the width (216 mm) of the letter-sized recording material. While setting the winding pitch in the intermediate areas to be smaller than the winding, pitches of the middle area and the end-portion areas so as to reduce the magnetic flux density in the intermediate areas, the winding pitch in the end-portion areas is set larger than the winding pitches of the middle area and the intermediate areas so as to increase the magnetic flux density in the end-portion areas. With the above, the heat generation amount in the sheet non-passing area can be made smaller than that of the second comparative example while the heat generation amount in the sheet passing area is made substantially the same as that of the second comparative example.

Figure 6:
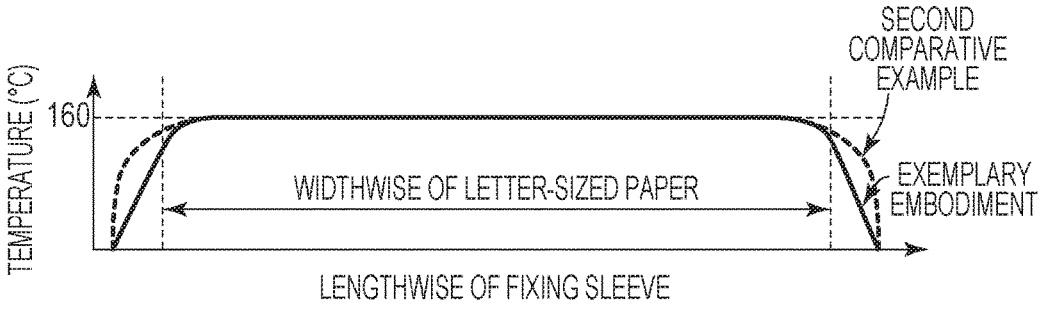
FIG. 6 is a graph illustrating temperature distributions.

FIG. 6 illustrates temperature distributions of the fixing sleeve 1 in the longitudinal direction when the coil 3 of the second comparative example and that of the exemplary embodiment were actually installed in the fixing apparatus A and when electric, power was fed to the coils. The temperature distributions were obtained by measuring, with an infrared thermography, the surface of the fixing sleeve 1 during warming up. When the temperature distribution of the present exemplary embodiment was compared with that of the second comparative example in FIG. 6, the temperature distributions of the present exemplary embodiment and the second comparative example were substantially similar to each other and were flat in the sheet passing area of the letter-sized recording, material, and the temperature distribution of the present exemplary embodiment was more close to a rectangular shape in the sheet non-passing area.

In order to verify the advantageous effect of the present exemplary embodiment, an experiment was conducted in which the degree of temperature rise in the sheet non-passing areas were compared using a printer mounted with the fixing apparatus of the exemplary embodiment and a printer mounted with the fixing apparatus of the second comparative example. The throughput was set to 60 sheets/min and a letter-sized recording material with a basis weight of 90 g/m were used. The drive frequency of the electric current distributed to the coil 3 was 60 kHz and the target control temperature of a thermistor 9 was 160° C. The member in the fixing apparatus A that has the lowest withstanding temperature limit was the fixing sleeve 1 and the elastic layer 1*b* of the fixing sleeve 1 melts at 230° C. The temperature rise in the sheet non-passing areas were monitored using thermistors 10 and 11 provided at positions corresponding to the letter-sized recording material non-passing area in the fixing sleeve 1.

Figure 7:
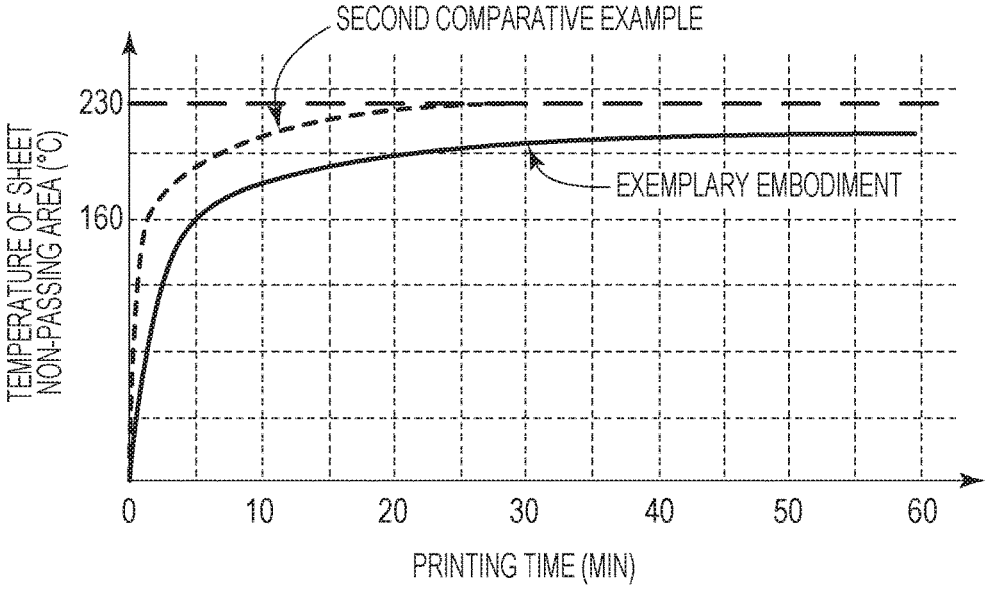
FIG. 7 is a graph illustrating changes in temperatures in sheet non-passing areas during continuous sheet passing.

FIG. 7 is a graph illustrating the experiment result. The axis of abscissas represents the printing time period and the axis of ordinates represents the temperature monitored by the thermistors 10 or 11. While in the present exemplary embodiment, the temperature of the sheet non-passing area of the fixing sleeve 1 after continuous printing of 60 minutes (3600 sheets) was 220° C. or under, in the second comparative example, the temperature reached 230° C. after 25 minutes (1500 sheets). In other words, it was found that while the throughput of the fixing apparatus of the second comparative example needed to be reduced to under 60 sheets/min before reaching 25 minutes, the throughput was capable of being maintained in the present exemplary embodiment.

As described above, by modifying the winding pitch of the coil, the present exemplary embodiment has an advantageous effect in that the fixability at the end portions is capable of being improved while suppressing the temperature rise in the sheet non-passing area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-123159, filed Jun. 18, 2015, which is hereby incorporated by reference herein in its entirety.

What is claimed is:

1. A fixing apparatus for fixing a toner image on a recording material while conveying and heating, at a nip portion, the recoding material on which the toner image has been formed, the fixing apparatus comprising:

a rotary member that includes a conductive layer;

a helical coil provided inside the rotary member, a helical axis of the helical coil extending in a generatrix direction of the rotary member;

a magnetic core provided inside the helical coil, the core having a shape that does not form a loop outside the conductive layer; and a back-up member that forms a nip portion together with the rotary member, wherein the conductive layer generates heat with an electric current flowing in the conductive layer, the electric current being induced by an alternating magnetic field generated by an electric current flowing in the helical coil, and wherein in the generatrix direction, when a winding pitch of the helical coil in a middle area, winding pitches in end-portion areas, and winding pitches in intermediate areas that are areas between the middle area and the end-portion areas are X, Y, and Z, respectively, then $Y<X<Z$ is satisfied.

2. The fixing apparatus according to claim 1, wherein in the generatrix direction, an end portion of the magnetic core is positioned outside an end portion of the recording material having a maximum width that can be used in the apparatus.

3. The fixing apparatus according to claim 1, wherein boundaries between the end-portion areas and the intermediate areas of the helical coil are positioned close to end portions of the recording material having the maximum width that can be used in the apparatus.

4. The fixing apparatus according to claim 1, wherein the winding pitch in the intermediate areas becomes larger from the middle area towards the end-portion areas.

5. The fixing apparatus according to claim 1, wherein when $X=1.0$, then $0.1<Y<1.0$ and $1.0<Z<1.5$ are satisfied.

6. The fixing apparatus according to claim 1, wherein the electric current induced in the conductive layer is an electric current that mainly flows in a circumferential direction of the conductive layer.

* * * * *